US008511538B2

(12) United States Patent
Ouillette

(10) Patent No.: US 8,511,538 B2
(45) Date of Patent: Aug. 20, 2013

(54) CONTAINER

(75) Inventor: Paul G. Ouillette, Noblesville, IN (US)

(73) Assignee: Dow AgroSciences LLC, Indianapolis, IN (US)

( * ) Notice: Subject to any disclaimer, the term of this patent is extended or adjusted under 35 U.S.C. 154(b) by 848 days.

(21) Appl. No.: 12/571,859

(22) Filed: Oct. 1, 2009

(65) Prior Publication Data

US 2010/0102112 A1 Apr. 29, 2010

Related U.S. Application Data

(60) Provisional application No. 61/107,799, filed on Oct. 23, 2008.

(51) Int. Cl.
*B65D 5/468* (2006.01)
*B65D 5/74* (2006.01)

(52) U.S. Cl.
USPC ..... 229/117.3; 229/117.11; 229/117.13; 229/117.16; 229/117.35; 229/136

(58) Field of Classification Search
USPC ..... 229/117.11, 117.13, 117.16, 117.22, 229/117.27, 117.3, 117.35, 132, 134, 136
See application file for complete search history.

(56) References Cited

U.S. PATENT DOCUMENTS

| | | | | | |
|---|---|---|---|---|---|
| 3,054,549 | A * | 9/1962 | Humphrey | 229/117.3 |
| 3,078,018 | A * | 2/1963 | Galloway | 222/183 |
| 3,090,526 | A * | 5/1963 | Hamilton et al. | 222/105 |
| 3,108,732 | A * | 10/1963 | Curie et al. | 229/117.3 |
| 3,349,986 | A * | 10/1967 | Chapman et al. | 229/117.3 |
| 4,887,718 | A * | 12/1989 | Anderson et al. | 229/132 |
| 5,201,462 | A * | 4/1993 | Sada et al. | 229/117.27 |
| 5,356,022 | A * | 10/1994 | Tipps | 229/117.3 |
| 5,909,841 | A * | 6/1999 | Andrews et al. | 229/117.35 |
| 6,736,289 | B2 * | 5/2004 | Cook et al. | 222/105 |
| 7,090,115 | B2 * | 8/2006 | Pierce | 229/136 |
| 2005/0211754 | A1 * | 9/2005 | Fulcher | 229/117.3 |
| 2006/0180643 | A1 * | 8/2006 | Stephenson | 229/117.3 |

FOREIGN PATENT DOCUMENTS

| | | |
|---|---|---|
| DE | 1486558 | 5/1969 |
| GB | 904470 | 8/1962 |
| GB | 944565 | 12/1963 |
| GB | 1021176 | 3/1966 |
| GB | 2403468 | 1/2005 |
| WO | WO2004089765 | 10/2004 |
| WO | WO2005000705 | 1/2005 |
| WO | WO2006014682 | 2/2006 |
| WO | WO2008043108 | 4/2008 |

OTHER PUBLICATIONS

Moen Industries, 3-piece bliss box designs, Internet site—http://www.moenindustries.com/MBoxGal3pc.html9/17/08.

(Continued)

*Primary Examiner* — Gary Elkins
(74) *Attorney, Agent, or Firm* — C. W. Arnett; Faegre Baker Daniels LLP

(57) ABSTRACT

A container is disclosed. The container may include a fillable bladder in an interior of an enclosure of the container. The container may be used for packaging a pourable product into a fillable bladder while the fillable bladder is positioned inside the container. The container may include an enclosure having a blind depth recess bottom handle. The container may include an enclosure having a bottom flap having a flap perimeter which generally matches a lower perimeter of a plurality of sides of the enclosure.

14 Claims, 10 Drawing Sheets

(56) References Cited

OTHER PUBLICATIONS

Scholle Packaging, Inc.; jerriboxTM, Welcome to the Future of Smart Pacakging!, Internet site—http://www.scholle.com/jerribox/ 2/29/08.

Scholle Packabing Inc.; Product Information for JerriboxTM; www.scholle.com/jerribox; 2 pages with headers—Jerribox: Delivering Value and Packing Supply Chain.

Smurfit Kappa Specialties Division; Jerribox Product Information; http://www.smurfitkappa-specialties.com/DropdownMenu/Products/Jerribox/2/29/08.

Smurfit Kappa Specialties Division; Working Principle, How Jerribox Works; www.http://smurfitkappa-jerribox.com/DropdownMenu/Jerribox/Working+Principle/2/29/08.

Smurfit Kappa Specialties Division; Jerribox, the environmentaly friendly and cost effective jerrican; http://www.smurfitkappa-jerribox.com/2/29/08.

Scholle JerriboxTM "Flexible Packaging Solutions" .PDF of product brochure, located at http://www.scholle.com/jerribox/pdf/Jerribox_brochure_9.26.06.pdf.

Written Opinion of the International Searching Authority, PCT/US2009/059224, Apr. 2011, (8 pages).

International Search Report, PCT/US2009/059224, Apr. 2010, (7 pages).

International Preliminary Report on Patentability, PCT/US2009/059224, Apr. 2011, (9 pages).

Response to Communication pursuant to Rules 161(1) and 162 EPC in European Application No. 09793 241.2, Dec. 2011, (9 pages).

Examination Report in New Zealand Application No. 592229, Apr. 2012, (2 pages).

* cited by examiner

CONTAINER

CROSS-REFERENCE TO RELATED APPLICATIONS

This application claims the benefit of U.S. Provisional Application 61/107,799 filed on Oct. 23, 2008.

FIELD OF THE INVENTION

The present invention relates to containers for holding a pourable product and in particular to containers having a fillable bladder and an enclosure supporting the fillable bladder.

BACKGROUND

Containers including a fillable bladder and a foldable enclosure are known. One such container is the JERRIBOX brand container available from Scholle Packaging having offices at 200 West North Avenue, in Northlake, Ill. 60164.

SUMMARY OF THE INVENTION

In an exemplary embodiment of the present disclosure, a container is provided having a fillable bladder and an associated enclosure supporting the fillable bladder. The enclosure may be made from a single piece of material. The enclosure may be made from a multiple pieces of material. The enclosure may include a blind depth handle on a bottom portion of the enclosure which aids in pouring a pourable product from the fillable bladder. The enclosure may be constructed such that an internal bottom surface is uninterrupted to reduce the possibility of compromising the integrity of the fillable bladder.

In another exemplary embodiment of the present disclosure, a container is provided. The container comprising an enclosure including a bottom portion, a top portion, and a plurality of sides which bound an interior of the enclosure. The plurality of sides having a lower perimeter and the bottom portion being formed from a plurality of bottom flaps extending from one or more of the plurality of sides. The container further comprising a fillable bladder positioned within the enclosure. An interior of the fillable bladder being accessible through an opening in the enclosure. A first bottom flap of the plurality of bottom flaps being positioned adjacent the fillable bladder. The first bottom flap having a flap perimeter which substantially matches the lower perimeter of the plurality of sides.

In an example, the bottom portion includes a blind depth handle having a bottom surface spaced apart from the a first surface of the first bottom flap which faces the interior of the enclosure. In a variation thereof, the blind depth handle is formed by an aperture in at least a second flap of the plurality of bottom flaps and a surface of at least one of the plurality of bottom flaps which faces away from the interior of the enclosure corresponding to the bottom surface of the blind depth handle. The second flap forming a portion of an exterior of the enclosure. In a further variation thereof, the surface of at least one of the plurality of bottom flaps is apart of a third flap positioned between the first bottom flap and the second flap. In another variation thereof, the top portion includes a handle which is in communication with the interior of the enclosure. The handle of the top portion and the blind depth handle of the bottom portion aiding in a pouring of a liquid from the interior of the fillable bladder through the opening in the enclosure. In another example, the top portion of the enclosure includes at least one top flap.

In a further example, the container further comprises a handle which is in communication with the interior of the enclosure and is positioned on a first side of the plurality of sides. In still another example, the enclosure is formed from a single piece of material having an unfolded state and a folded state. In a variation thereof, the single piece of material is a corrugated material. In a further variation thereof, the corrugated material includes a first side, a second side, a third side, and a fourth side which form the plurality of sides; a first top flap extending from the first side, a second top flap extending from the second side, a third top flap extending from the third side, and a fourth top flap extending from the fourth side which form the top portion; the first bottom flap extending from the first side, a second bottom flap extending from the second side, a third bottom flap extending from the third side, and a fourth bottom flap extending from the fourth side which form the bottom portion; and a side flap extending from the first side opposite the second side, wherein the side flap overlaps and is secured to a portion of the fourth side when the corrugated material is in the folded state. In still a further variation, the third side and the third top flap include edges which define an exterior edge of the opening of the enclosure and the first top flap, the second top flap, and the fourth top flap each include a first recess which correspond to the opening of the enclosure. A handle in the top portion is formed by a handle opening in each of the first top flap and the third top flap and a second recess in each of the second top flap and the fourth top flap. A first side handle is formed by an opening in the second side. A second side handle is formed by an opening in the fourth side. In yet still a further variation, the side flap and the portion of the fourth side are secured with an adhesive and at least one of the side flap and the portion of the fourth side includes perforations which allow for the adhesive to penetrate into an interior of the respective at least one of the side flap and the portion of the fourth side. In another variation, the container further comprises a holder including a base which is supported by the enclosure, a neck which is coupled to the base and is in fluid communication with the interior of the fillable bladder; and a cap which is removably coupled to the neck. In a further variation thereof, the base includes a plurality of locking members which engage the enclosure to couple the base to the enclosure. In still a further variation thereof, the plurality of locking members engage a portion of an inward-facing surface of the third top flap, the portion of the inward-facing surface of the third top flap being exposed by the first recess in each of the first top flap, the second top flap, and the third top flap.

In a further exemplary embodiment, a container is provided. The container comprising an enclosure including a bottom portion, a top portion, and a plurality of sides which bound an interior of the enclosure; and a fillable bladder positioned within the interior of the enclosure. An interior of the fillable bladder being accessible through an opening in a front half of the enclosure. The enclosure includes a handle in a rear half of the enclosure and a blind depth recess handle in the bottom portion of the enclosure. The handle and the blind depth recess handle being located to aid in a pouring of a liquid from the interior of the fillable bladder through the opening in front half of the enclosure.

In an example, the blind depth recess handle is in the rear half of the enclosure and the handle is in the top portion of the enclosure and is in communication with the interior of the enclosure. In another example, the blind depth recess handle is formed by an aperture in at least a first flap of a plurality of bottom flaps of the bottom portion and a surface of at least one other flap of the plurality of bottom flaps which faces away from the interior of the enclosure. The surface corresponding to a bottom surface of the blind depth recess handle. The first flap forming a portion of an exterior of the enclosure.

In a further example, the enclosure is formed from a single piece of material having an unfolded state and a folded state. The single piece of material including a first side, a second side, a third side, and a fourth side which form the plurality of sides; a first top flap extending from the first side, a second top flap extending from the second side, a third top flap extending from the third side, and a fourth top flap extending from the fourth side which form the top portion; a first bottom flap extending from the first side, a second bottom flap extending from the second side, a third bottom flap extending from the third side, and a fourth bottom flap extending from the fourth side which form the bottom portion; and a side flap extending from the first side opposite the second side. The side flap overlaps and is secured to a portion of the fourth side when the single piece of material is in the folded state. In a variation, the third side and the third top flap include edges which define an exterior edge of the opening of the enclosure. The first top flap, the second top flap, and the fourth top flap each include a first recess which correspond to the opening of the enclosure. The handle in the top portion of the enclosure is formed by a handle opening in each of the first top flap and the third top flap and a second recess in each of the second top flap and the fourth top flap. A first side handle is formed by an opening in the second side. A second side handle is formed by an opening in the fourth side. In a further variation thereof, the container further comprises a holder including a base which is supported by the enclosure, a neck which is coupled to the base and is in fluid communication with the interior of the fillable bladder; and a cap which is removably coupled to the neck.

In still another exemplary embodiment of the present disclosure, a method of constructing an enclosure is provided. The method including the step of obtaining a single piece of corrugated material which is foldable to form the enclosure. The single piece of corrugated material including at least a first side, a second side, a third side, and a fourth side which form a plurality of sides of the enclosure; a plurality of top flaps which form a top portion of the enclosure; a plurality of bottom flaps which form a bottom portion of the enclosure; and a side flap extending from the first side opposite the second side. The method further comprising the step of folding the single piece of corrugated material so that the first side is generally parallel with the third side, the second side is generally parallel with the fourth side, and the side flap overlaps a portion of the fourth side and is visible from an exterior of the enclosure. The plurality of sides having a lower perimeter. The method further comprising the steps of securing the side flap to the portion of the fourth side; and folding the single piece of corrugated material so that an inward-facing surface of one of the plurality of bottom flaps is generally perpendicular to the first side and is visible from a direction looking down through the plurality of sides. The one of the plurality of bottom flaps having a flap perimeter which generally matches the lower perimeter of the plurality of sides. The method further comprising the steps of folding the remaining flaps of the plurality of bottom flaps onto the one of the plurality of bottom flaps to form the bottom portion of the enclosure; securing the plurality of bottom flaps to at least two of the plurality of sides of the enclosure; folding the plurality of top flaps to form the top portion of the enclosure; securing the plurality of top flaps to at least two of the plurality of sides of the enclosure; placing a fillable bladder within an interior of the enclosure, the fillable bladder being coupled to a holder which is supported by the enclosure, the holder including an opening through which a pourable product may be placed into an interior of the fillable bladder; placing the pourable product into the interior of the fillable bladder; and closing the opening of the holder to retain the pourable product in the interior of the fillable bladder.

In an example, the plurality of top flaps include a first top flap extending from the first side, a second top flap extending from the second side, a third top flap extending from the third side, and a fourth top flap extending from the fourth side and the plurality of bottom flaps include a first bottom flap extending from the first side, a second bottom flap extending from the second side, a third bottom flap extending from the third side, and a fourth bottom flap extending from the fourth side. In a variation, the step of securing the side flap to the portion of the fourth side includes the step of interposing an adhesive between the side flap and the portion of the fourth side. At least one of the side flap and the portion of the fourth side including perforations which allow for the adhesive to penetrate into an interior of the respective at least one of the side flap and the portion of the fourth side. In a further variation thereof, the bottom portion includes a blind depth recess handle formed by an opening in at least a first one of the plurality of bottom flaps and an outward-facing surface of a second one of the plurality of bottom flaps.

In another example, the enclosure includes an opening for receiving the fillable bladder and the holder includes a flange which is supported by the enclosure proximate to the opening in the enclosure which receives the fillable bladder. In yet a further variation, the method further comprises the steps of folding the piece of material such that the enclosure defines the opening and an undercut positioned proximate the opening; and positioning a holder within the opening in the enclosure, the holder including a locking member positioned in the undercut to limit a movement of the holder relative to the enclosure.

In yet a further exemplary embodiment of the present disclosure, a method of pouring a pourable product is provided. The method including the steps of obtaining a container having a pourable product positioned within a fillable bladder positioned in an interior of an enclosure of the container, an interior of the fillable bladder being in fluid communication with an exterior of the container through a neck; gripping the container through a handle in a rear portion of the container and a blind depth handle on a bottom portion of the container; and raising a bottom portion of the container relative to the top while gripping the handle and the blind depth handle to pour the pourable product through the neck of the container. The blind depth handle being spaced further from the neck than the handle is spaced from the neck. In an example, the enclosure of the container is made from a single piece of corrugated material which is foldable to form an enclosure. The single piece of corrugated material including at least a first side, a second side, a third side, and a fourth side which form a plurality of sides of the enclosure; a plurality of top flaps which form a top portion of the enclosure; a plurality of bottom flaps which form a bottom portion of the enclosure; and a side flap extending from the first side opposite the second side.

In yet still another exemplary embodiment of the present disclosure, a method of pouring a pourable product is provided. The method including the steps of: obtaining a container having the pourable product positioned within a fillable bladder positioned in an interior of an enclosure of the container, an interior of the fillable bladder being in fluid communication with an exterior of the container through a neck;

gripping the container through a strap handle in a rear portion of the container and a blind depth handle on a bottom portion of the container; and raising the bottom portion of the container relative to the top while gripping the strap handle and the blind depth handle to pour the pourable product through the neck of the container. The blind depth handle being spaced further from the neck than the strap handle is spaced from the neck. In an example, the enclosure of the container is made from a single piece of corrugated material which is foldable to form an enclosure. The single piece of corrugated material including at least a first side, a second side, a third side, and a fourth side which form a plurality of sides of the enclosure; a plurality of top flaps which form a top portion of the enclosure; a plurality of bottom flaps which form a bottom portion of the enclosure; and a side flap extending from the first side opposite the second side. In an alternative example, the enclosure of the container is made from multiple pieces of corrugated material.

Additional features and advantages of the present invention will become apparent to those skilled in the art upon consideration of the following detailed description of the illustrative embodiments exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention descried herein are not intended to be exhaustive or to limit the invention to the precise forms disclosed. Rather, the embodiments selected for description have been chosen to enable one skilled in the art to practice the invention. Although the disclosure is described as a container for enclosing a foldable fillable bladder it should be understood that the concepts presented herein may be used in various applications and should not be limited to use in connection with a foldable fillable bladder.

Figure 1:
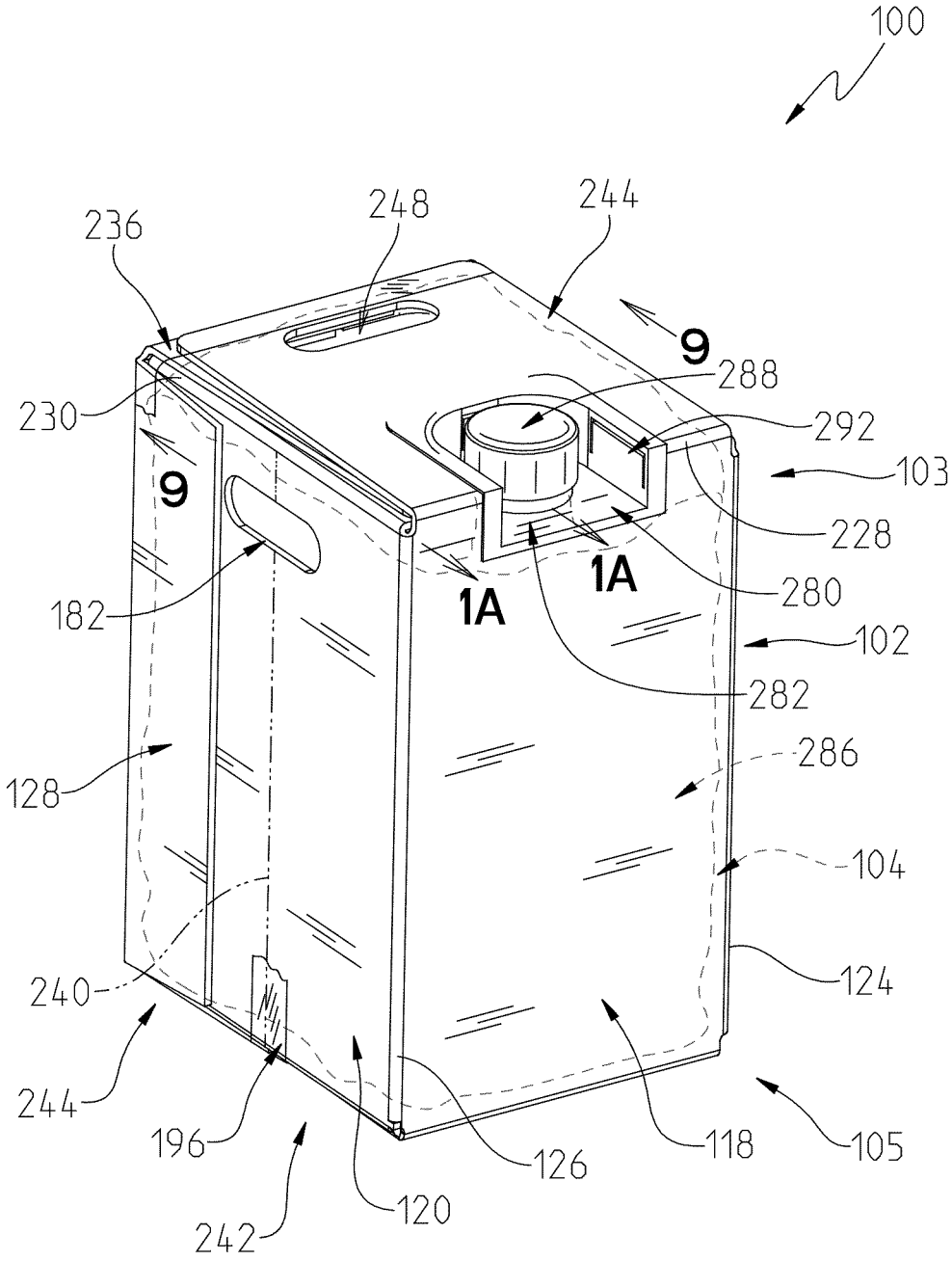
FIG. 1 illustrates a perspective view of a container including an enclosure and a fillable bladder in the distended position.

Referring to FIG. 1, a container 100 is shown having an enclosure 102 and a fillable bladder 104. In the illustrated embodiment, enclosure 102 is made from a single foldable component 106 (see FIG. 2) and fillable bladder 104 is a bladder is made from a foldable material. Fillable bladder 104 is disposed within an interior 101 of enclosure 102. In one embodiment, fillable bladder 104 may be a rigid bladder, such as a plastic jug or other suitable types of bladders.

Enclosure has a top portion 103 and a bottom portion 105. In one embodiment, enclosure 102 may be formed from multiple components which are assembled together to form the enclosure. Exemplary components include foldable components and rigid components. In one embodiment, foldable component 106 is a single piece of corrugated cardboard. In one embodiment, the single piece of corrugated cardboard includes multiple layers of corrugated cardboard. In one example, the single piece of corrugated cardboard includes two layers of corrugated cardboard. In one embodiment, reinforced tape is integrated into one or more layers of the corrugated material to improve bulge resistance.

Figure 11:
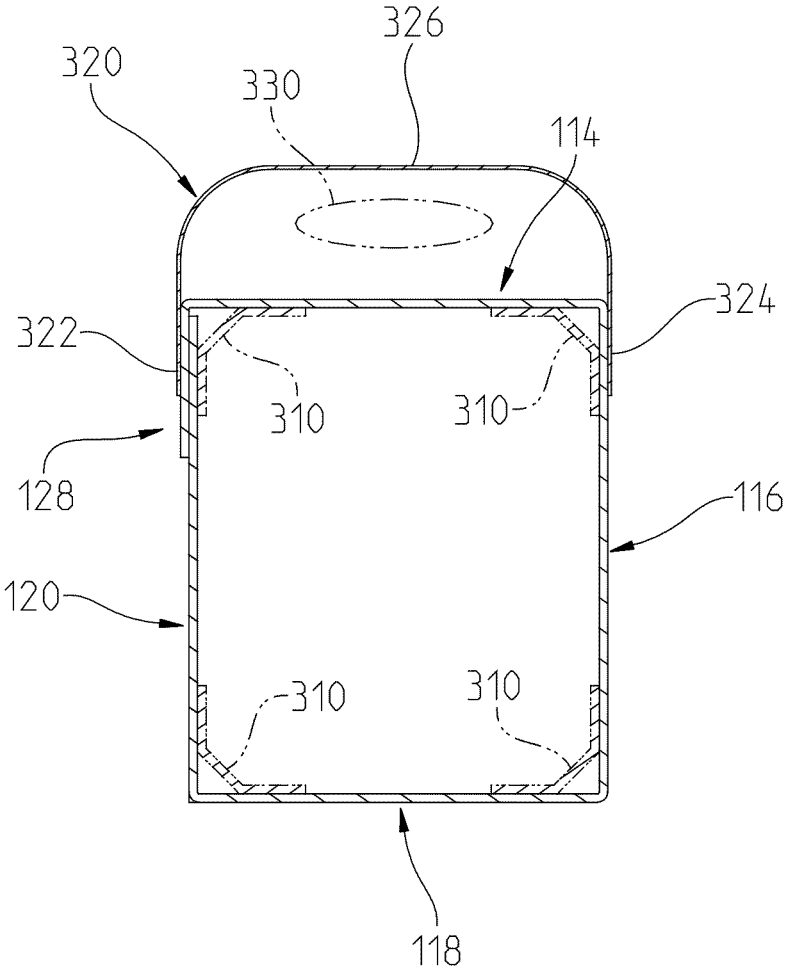
FIG. 11 illustrates a sectional view of the container along lines 11-11 in FIG. 10 with the bladder removed from the section.

In one embodiment, foldable component 106 is made of multiple components. In one example, foldable component 106 includes reinforcing sections of cardboard placed along the vertical edges of enclosure 102 similar to a 3-Piece Bliss Box brand container available from Moen Industries located at 12333 East Los Nietos Road, Santa Fe Springs, Calif. 90670. Referring to FIG. 11, the location of reinforcing cardboard sections 310 are shown in phantom. Four reinforcing cardboard sections 310 are shown, one for each corner of the enclosure 102. In one embodiment, at least one of the corners does not have a corresponding reinforcing cardboard section 310. In one embodiment, reinforcing cardboard sections 310 extend the length of side walls 114, 116, 118, and 120. In one embodiment, reinforcing cardboard sections 310 are shorter than the length of side walls 114, 116, 118, and 120. Further, in one embodiment, enclosure 102 may include components have different material types, such as single wall cardboard, double wall cardboard, and plastic material.

Figure 2:
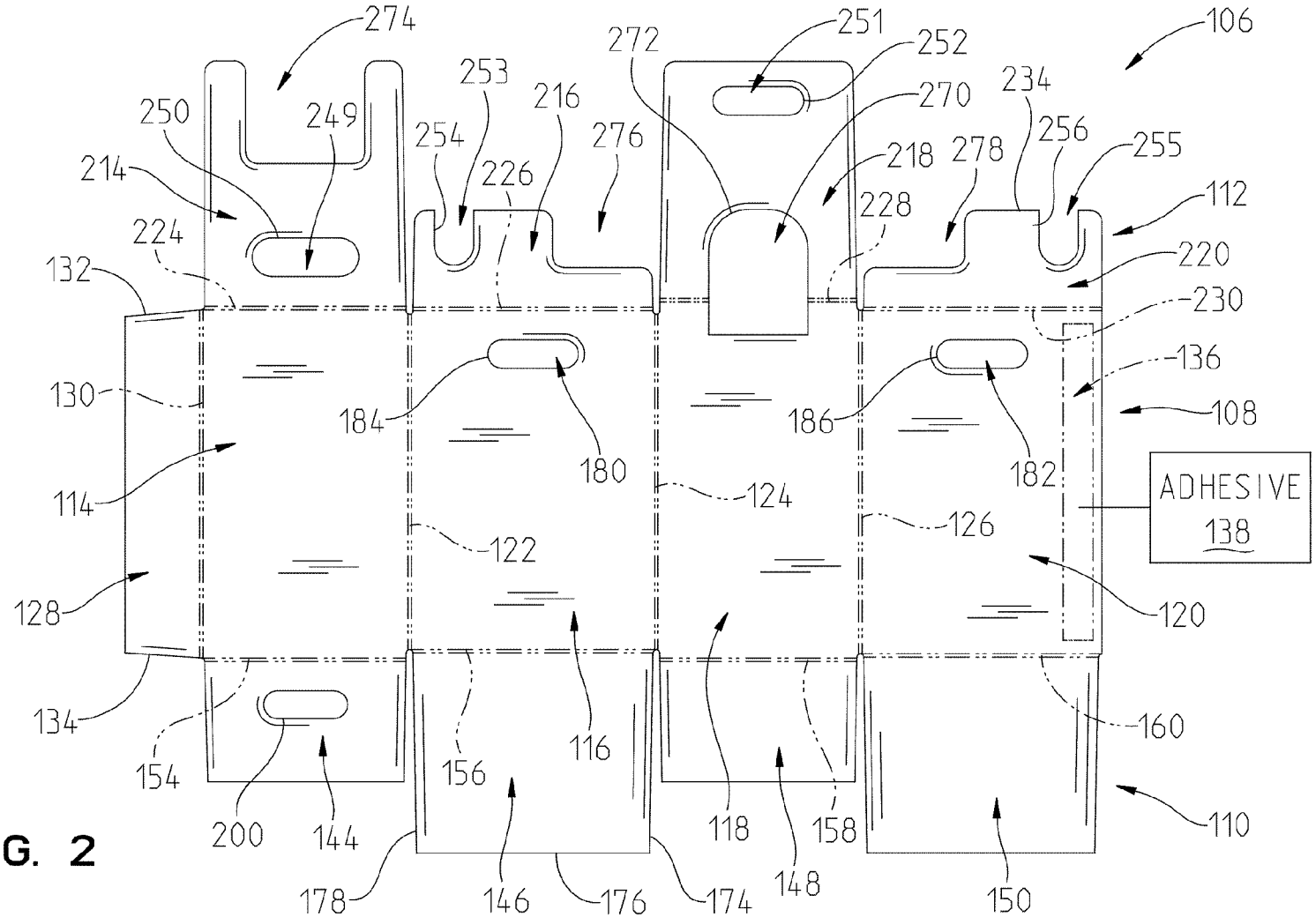
FIG. 2 illustrates a plan view of a single piece of material used to construct the enclosure.

Referring to FIG. 2, foldable component 106 includes a plurality of sides 108, a plurality of bottom flaps 110, and a plurality of top flaps 112. Plurality of sides 108 includes a first side 114, a second side 116, a third side 118, and a fourth side 120. Although four sides are illustrated, plurality of sides 108 may include less than four sides or more than four sides. First side 114 is foldable relative to second side 116 at a first fold line 122. Second side 116 is foldable relative to third side 118 at a second fold line 124. Third side 118 is foldable relative to fourth side 120 at a third fold line 126.

A side flap 128 is foldable relative to first side 114 at a fourth fold line 130. Upper and lower edges 132 and 134 of side flap 128 are tapered away from first side 114. Referring to FIG. 1, side flap 128 overlaps a portion 136 (see FIG. 2) of fourth side 120. In one embodiment, a width of side flap 128 is about one-third of a width of fourth side 120. In one embodiment, the width of side flap 128 is at least about 36% of the width of fourth side 120. In one embodiment, a width of side flap 128 is about 3.5 inches. In one embodiment, a width of side flap 128 is about 4.0 inches.

Figure 3:
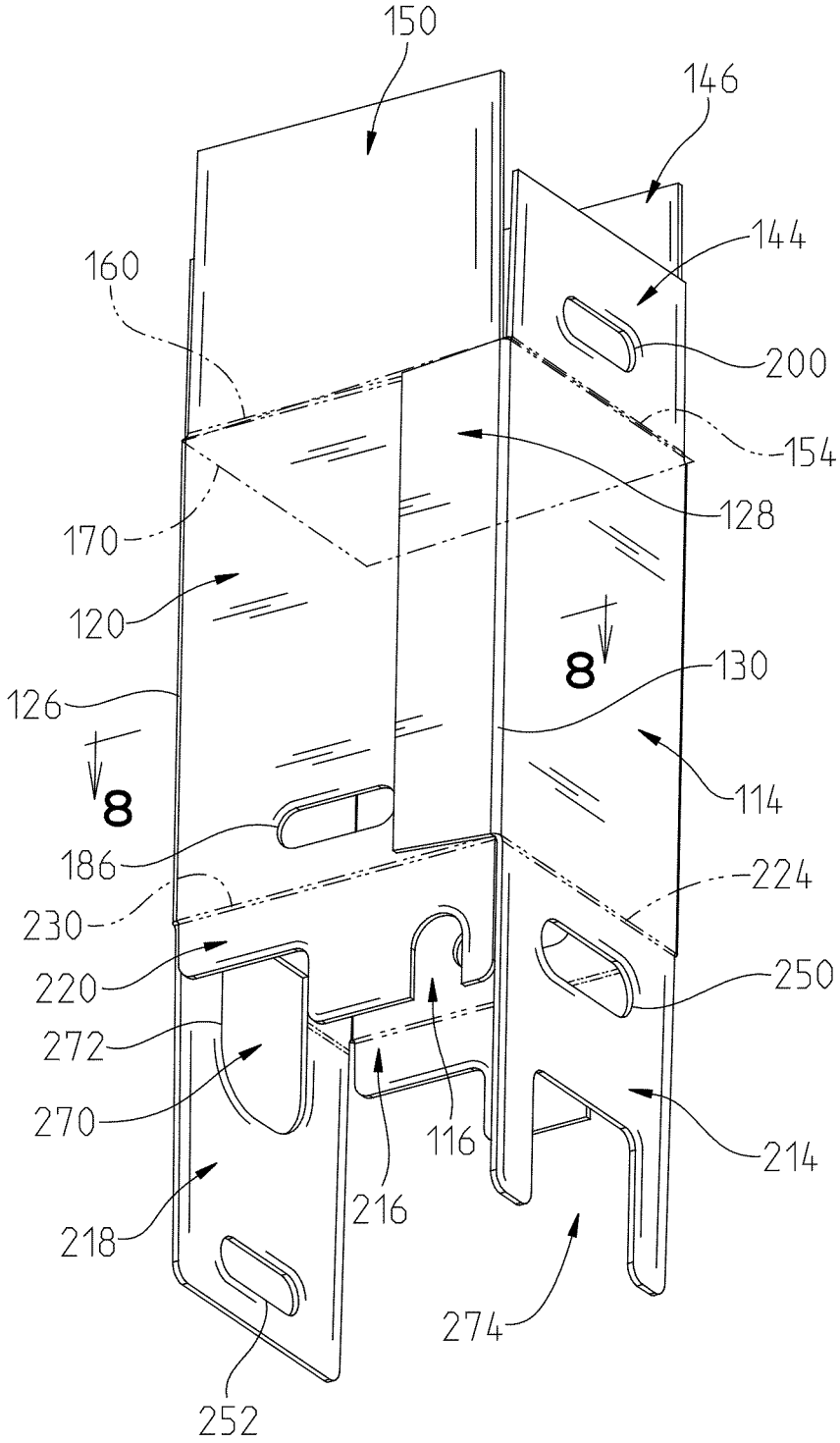
FIG. 3 illustrates a perspective view of the enclosure shown with the fully open top and bottom portions and the plurality of sides in a folded state, also illustrated is a side flap, integral with a side in the plurality of sides of the enclosure, shown engaged to the outside of an adjacent side of the enclosure.
Figure 8:
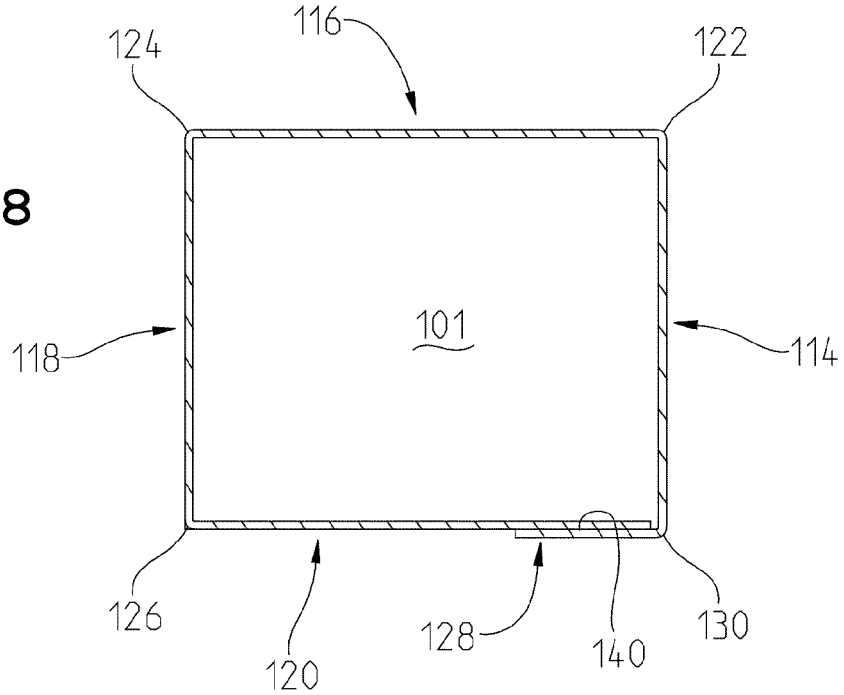
FIG. 8 illustrates a sectional view along line 8-8 in FIG. 3.

Referring to FIG. 3, foldable component 106 is shown with first side 114 folded relative to second side 116 at first fold line 122, second side 116 folded relative to third side 118 at second fold line 124, third side 118 folded relative to fourth side 120 at third fold line 126, and side flap 128 folded relative to first side 114 at fourth fold line 130. Side flap 128 overlaps portion 136 of fourth side 120 and is visible from the exterior of enclosure 102. Further, side flap 128 is secured such that it generally does not move relative to fourth side 120. In one embodiment, side flap 128 is secured with tape. In one embodiment, an adhesive 138 is positioned between side flap 128 and portion 136 of fourth side 120. Exemplary adhesive include water resistant adhesives. In one embodiment, at least one of a lower surface 140 (see FIG. 8) of side flap 128 and portion 136 of fourth side 120 includes perforations which permit the adhesive to pass into an interior portion of the at least one of side flap 128 and fourth side 120. The depth of the perforation should be at least through an outer liner material of foldable component 106 and may extend deeper into the flutes of that layer or, if present, into deeper layers of material.

Returning to FIG. 2, second side 114 and fourth side 120 each include a respective handle 180 and 182 which are bounded by edges 184 and 186, respectively. Handles 180 and 182 are oblong shaped. In one embodiment, additional handles are provided on at least one of first side 114 and third side 118.

A first bottom flap 144, a second bottom flap 146, a third bottom flap 148, and a fourth bottom flap 150 extend from first side 114, second side 116, third side 118, and fourth side 120, respectively. First bottom flap 144, second bottom flap 146, third bottom flap 148, and fourth bottom flap 150 are foldable relative to first side 114, second side 116, third side 118, and fourth side 120 along first bottom fold line 154, second bottom fold line 156, third bottom fold line 158, and fourth bottom fold line 160, respectively. Each of first bottom flap 144, second bottom flap 146, third bottom flap 148, and fourth bottom flap 150 are illustrated as extending generally across an entire width of the respective first side 114, second side 116, third side 118, and fourth side 120. In one embodiment, one or more of first bottom flap 144, second bottom flap 146, third bottom flap 148, and fourth bottom flap 150 extends only partially across the width of first side 114, second side 116, third side 118, and fourth side 120. In one embodiment, one or more of first bottom flap 144, second bottom flap 146, third bottom flap 148, and fourth bottom flap 150 include multiple flaps. In one embodiment, at least one of first bottom flap 144, second bottom flap 146, third bottom flap 148, and fourth bottom flap 150 are not included and foldable component 106 includes only three or less bottom flaps.

Referring to FIG. 3, the lower edges of first side 114, second side 116, third side 118, and fourth side 120 (generally first bottom fold line 154, second bottom fold line 156, third bottom fold line 158, and fourth bottom fold line 160) define a lower perimeter 170 of enclosure 102. At least one of first bottom flap 144, second bottom flap 146, third bottom flap 148, and fourth bottom flap 150 has a flap perimeter which generally matches lower perimeter 170. In the illustrative embodiment, second bottom flap 146 includes a flap perimeter 172 generally defined by second bottom fold line 156, edge 174, edge 176, and edge 178.

Figure 5:
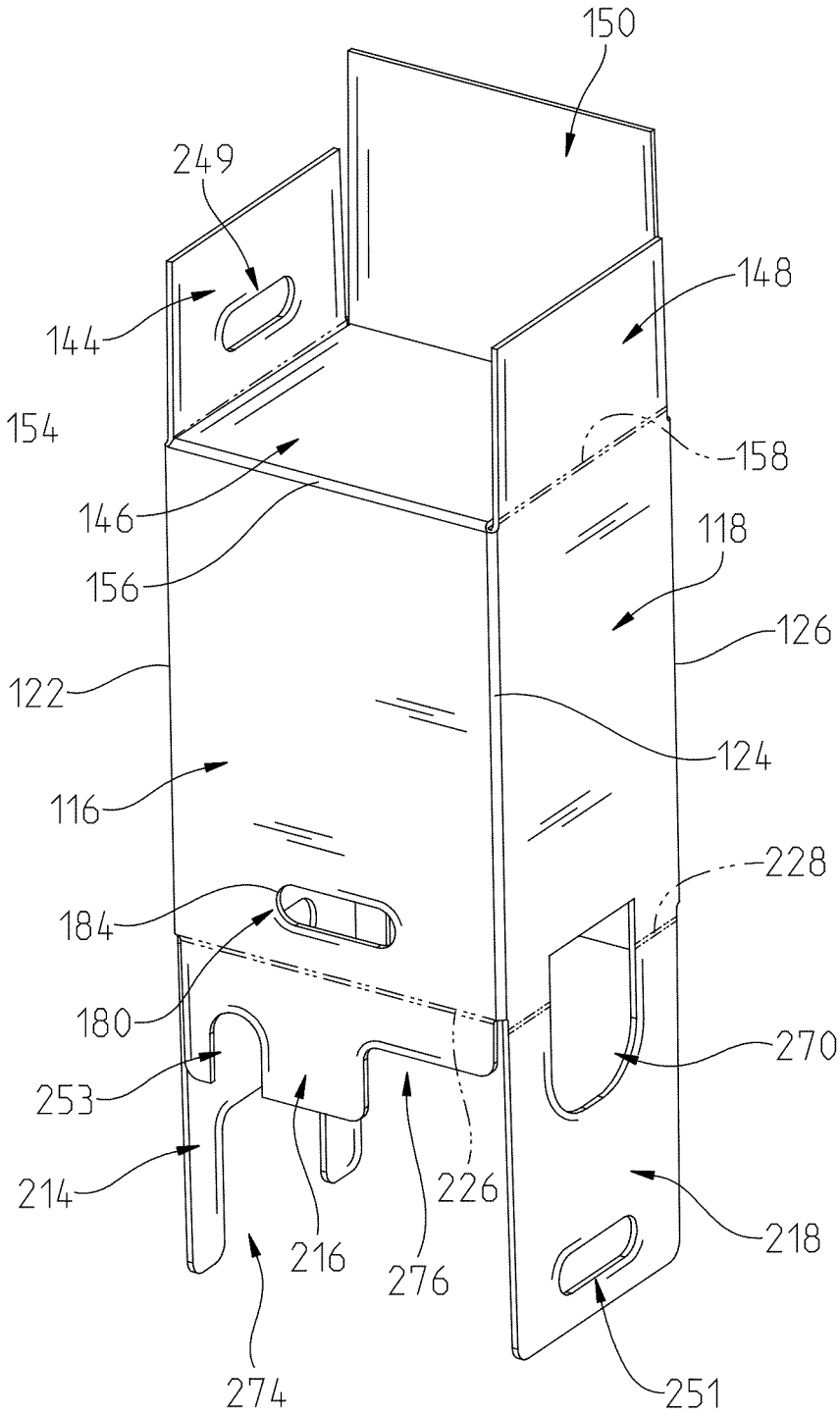
FIG. 5 illustrates a perspective view of the enclosure shown with the first bottom flap folded to form the interior bottom wall of the enclosure.

Referring to FIG. 5, second bottom flap 146 is first folded along second bottom fold line 156 such that second bottom flap 146 is generally perpendicular to each of first side 114, second side 116, third side 118, and fourth side 120. Also, flap perimeter 172 of second bottom flap 146 generally matches lower perimeter 170 of enclosure 102. As such, second bottom flap 146 generally provides an uninterrupted bottom wall 190 for enclosure 102. This uninterrupted bottom wall 190 of enclosure 102 has a generally smooth surface with no seams since it is a single flap. As such, when fillable bladder 104 is a flexible fillable bladder that includes a pourable product, fillable bladder 104 does not rub against a seam or other rough edge in uninterrupted bottom wall 190. This assists in maintaining the integrity of fillable bladder 104.

Exemplary types of pourable products include liquids, gels, granular material, and other materials which may be poured from a container. Pourable products may include liquids, granular materials, flowable materials, liquid pesticides, solid or granular pesticides, herbicides, insecticides, fungicides, seeds, clay, and other types of pourable agricultural materials.

Figure 4:
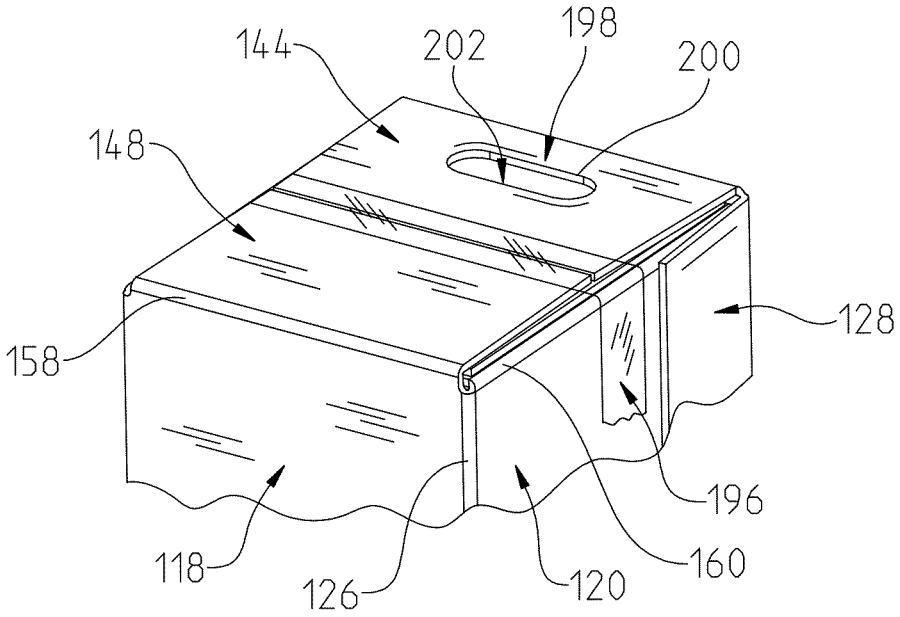
FIG. 4 illustrates a perspective view of the bottom portion of the enclosure, illustrating a blind depth recessed handle.
Figure 6:
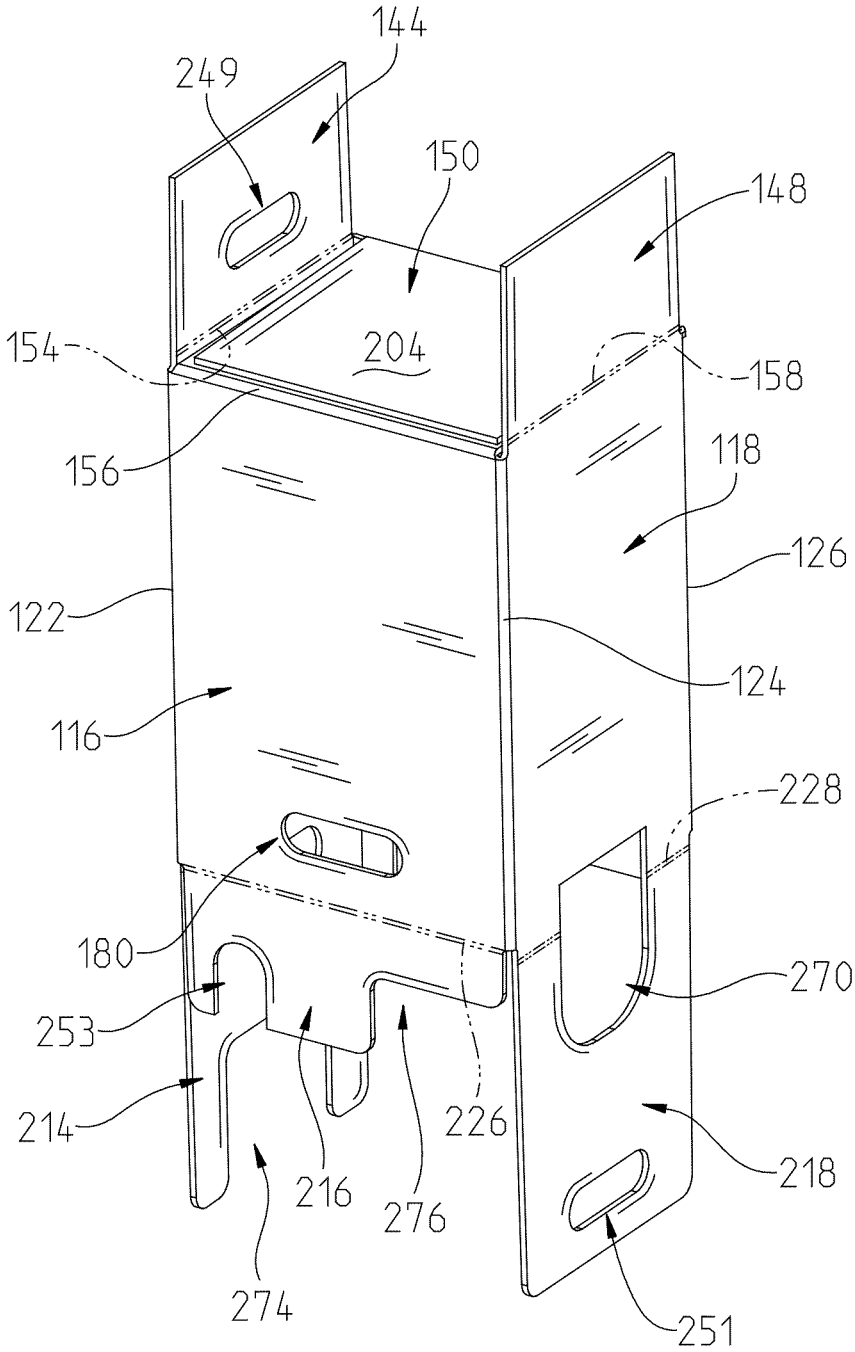
FIG. 6 illustrates a perspective view of the enclosure with a second bottom flap folded over the first bottom flap.

To complete the forming of bottom portion 105, fourth bottom flap 150 is folded along fourth bottom fold line 160 to overlap second bottom flap 146 (see FIG. 6) and first bottom flap 144 and third bottom flap 148 are folded along first bottom fold line 154 and third bottom fold line 158, respectively, to overlap fourth bottom flap 150 (see FIG. 4). The flaps of bottom portion 105 are then generally secured in place. In one embodiment, adhesive is provided between fourth bottom flap 150 and the combination of first bottom flap 144 and third bottom flap 148 and/or between second bottom flap 146 and fourth bottom flap 150. In one embodiment, tape 196 (see FIG. 4) covers and is secured to a portion of each of first bottom flap 144 and third bottom flap 148. The tape 196 also is secured to second side 116 and fourth side 120.

Bottom portion 105 also includes a handle 198. Handle 198 has a generally oblong perimeter 200 and is spaced apart from the external edges of first bottom flap 144. In one embodiment, handle 198 includes at least one external edge of first bottom flap 144. Handle 198 is a blind depth handle meaning that the hand of the operator gripping handle 198 is not in contact with an interior of enclosure 102 containing fillable bladder 104 and therefore is spaced apart from Returning to FIG. 2, a first top flap 214, a second top flap 216, a third top flap 218, and a fourth top flap 220 extend from first side 114, second side 116, third side 118, and fourth side 120, respectively. First top flap 214, second top flap 216, third top flap 218, and fourth top flap 220 are foldable relative to first side 114, second side 116, third side 118, and fourth side 120 along first top fold line 224, second top fold line 226, third top fold line 228, and fourth top fold line 230, respectively. Each of first top flap 214, second top flap 216, third top flap 218, and fourth top flap 220 are illustrated as extending generally across an entire width of the respective first side 114, second side 116, third side 118, and fourth side 120. In one embodiment, one or more of first top flap 214, second top flap 216, third top flap 218, and fourth top flap 220 extends only partially across the width of first side 114, second side 116, third side 118, and fourth side 120. In one embodiment, one or more of first top flap 214, second top flap 216, third top flap 218, and fourth top flap 220 include multiple flaps. In one embodiment, at least one of first top flap 214, second top flap 216, third top flap 218, and fourth top flap 220 are not included and foldable component 106 includes only three or less top flaps.

To form top portion 103, second top flap 216 and fourth top flap 220 are first folded along second top fold line 226 and fourth top fold line 230 such that second top flap 216 and fourth top flap 220 are generally perpendicular to each of first side 114, second side 116, third side 118, and fourth side 120. An edge 232 of second top flap 216 and an edge 234 of fourth top flap 220 are generally positioned proximate to each other. Next, first top flap 214 is folded along first top fold line 224 and overlaps second top flap 216 and fourth top flap 220. Third top flap 218 is then folded along third top fold line 228 and overlaps first top flap 214.

The flaps of top portion 103 are then generally secured in place. In one embodiment, adhesive is provided between first top flap 214 and the combination of second top flap 216 and fourth top flap 220 and/or between first top flap 214 and third top flap 218. In one embodiment, tape 236 (see FIG. 1) covers and is secured to a portion of each of third top flap 218. The tape 236 is also secured to second side 116 and fourth side 120.

Figure 9:
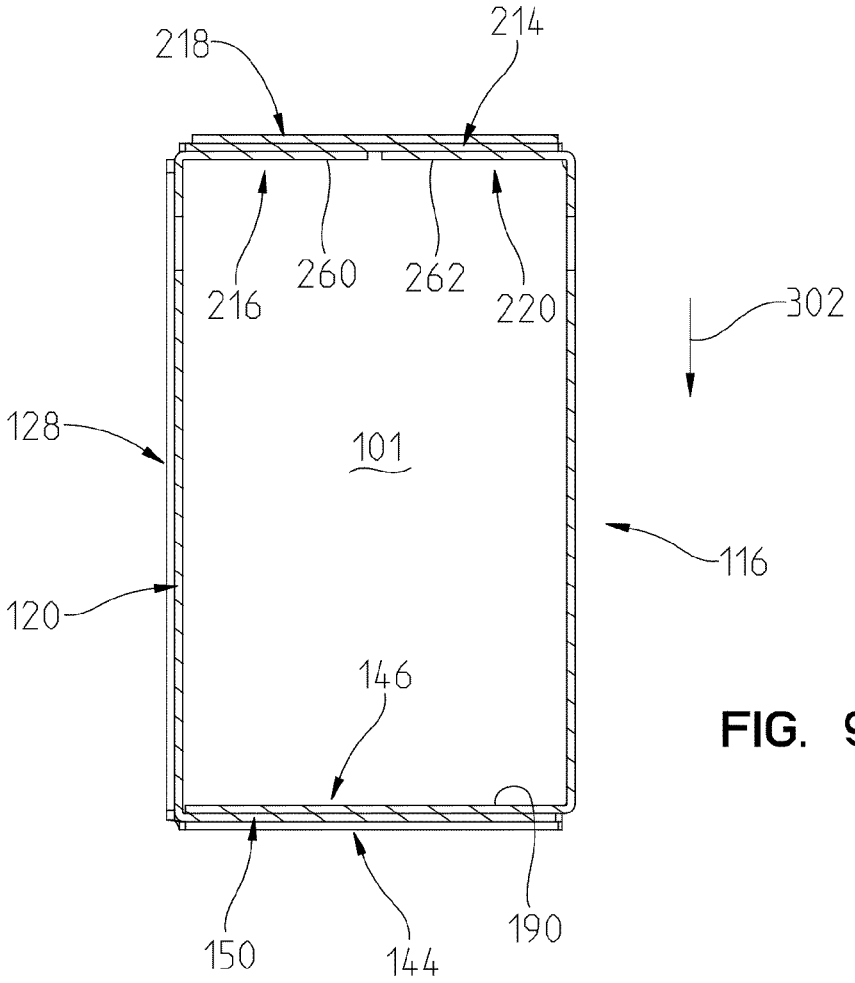
FIG. 9 illustrates a cross sectional view of the enclosure taken along line 9-9 in FIG. 1.

Referring to FIG. 1, enclosure 102 is divided by a plane 240 (indicated by dashed lines in FIG. 1) into a front half 242 and a rear half 244. Plane 240 coincides with the sectional view of FIG. 9. Rear half 244 includes handle 198 in bottom portion 105. Rear half 144 further includes a handle 248. Illustratively, handle 248 is provided in top portion 103. In one embodiment, handle 248 is provided in a top portion of first side 114.

Handle 248 is formed by an aperture 249 in first top flap 214 bounded by edges 250, an aperture 251 in third top flap 218 bounded by edges 252, a recess 253 in second top flap 216 partially bounded by edges 254, and a recess 255 in fourth top flap 220 partially bounded by edges 256. Handle 248 is in communication with an interior of enclosure 102. This allows an operator to place their hand partially through the opening and grip the interior surfaces 260 and 262 of second top flap 216 and fourth top flap 220, respectively, and carry enclosure 102 with a single hand.

Figure 7:
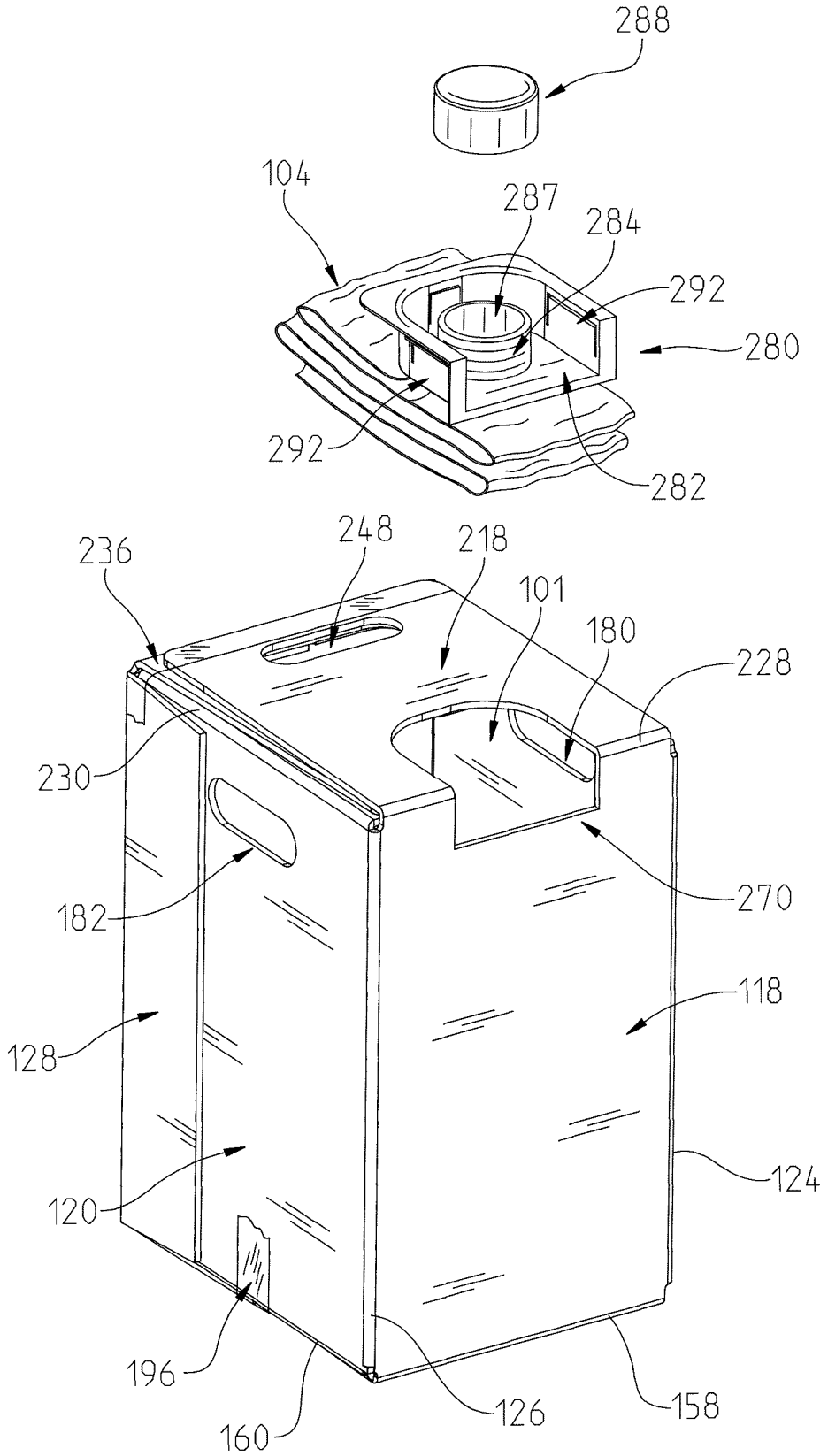
FIG. 7 illustrates an exploded perspective view of the folded enclosure and the fillable bladder shown in a collapsed state connected to a holder.

Referring to FIG. 7, enclosure 102 includes an aperture 270 through which fillable bladder 104 is placed into interior of enclosure 102. Aperture 270 is also the location through which a pourable product is placed into fillable bladder 104 and is poured from fillable bladder 104.

Referring to FIG. 2, third side 118 and third top flap 218 cooperate to form a boundary 272 of aperture 270. First top flap 214, second top flap 216, and fourth top flap 220 each include respective recesses 274, 276, and 278 which when folded to form top portion 103 do not diminish the effective size of aperture 270.

Referring to FIG. 7, with enclosure 102 formed, fillable bladder 104 is positioned within interior of enclosure 102. As shown in FIG. 7, fillable bladder 104 is in a collapsed state. As represented in FIG. 1, fillable bladder 104 is in an distended state.

Figure 1A:
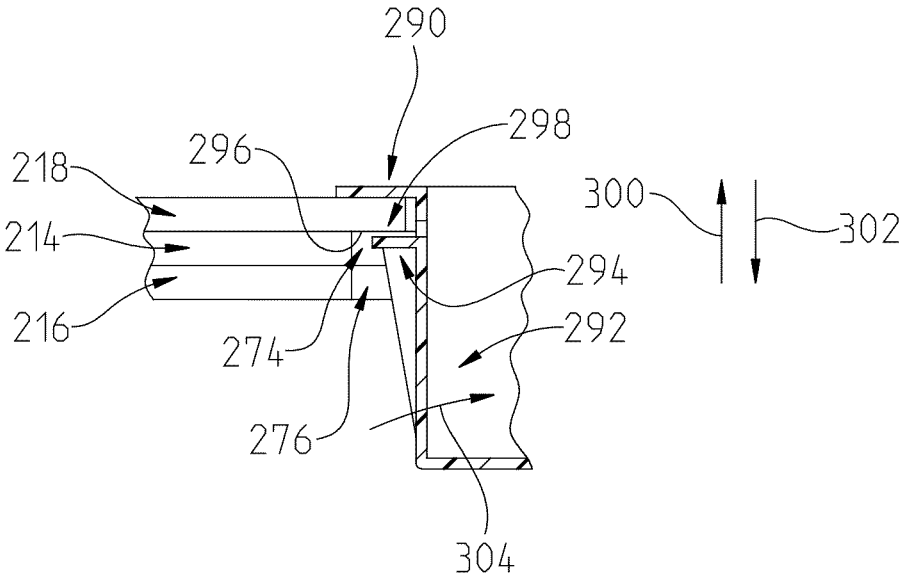
FIG. 1*a* illustrates a sectional view of a holder and the enclosure along line 1A-1A in FIG. 1.

Fillable bladder 104 is coupled to a holder 280. Holder 280 includes a base 282 which is supported by enclosure 102 as shown in FIG. 1A, a neck 284 which is coupled to the base 282 and is in fluid communication with an interior 286 of fillable bladder 104 through an opening 287; and a cap 288 which is removably coupled to neck 284. Cap 288 is threadably coupled to neck 284.

In one embodiment, fillable bladder 104 and holder 280 correspond to a bladder and a cassette provided as a part of the JERRIBOX brand container available from Scholle Packaging having offices at 200 West North Avenue, in Northlake, Ill. 60164.

Referring to FIG. 1A, base 282 includes a flange 290 which rests on third top flap 218. Base 282 further includes a plurality of locking members 292. As shown in FIG. 1A, locking member 292 includes an upper portion 294 which is positioned proximate to a lower surface 296 of third top flap 218. Flange 290 and upper portion 294 generally capture a portion 298 of third top flap 218 and minimize the movement of holder 280 in direction 300 and direction 302. Upper portion 294 of plurality of locking members 292 is deflectable in direction 304 such that upper portion 294 may be moved to permit the movement of holder 280 in direction 300.

Recesses 274 and 276 in first top flap 214 and second top flap 216, respectively, provide an undercut relative to third top flap 218. This undercut allows upper portion 294 to be in the position shown in FIG. 1A; thereby permitting upper portion 294 to engage lower surface 296 which is exposed by the recess 274 in first top flap 214 and recess 276 in second top flap 216. A similar undercut is provided on the opposite side of opening 270 which interacts with a second locking member 292 of holder 280.

The undercut of enclosure 102 supports the holder 280 while cap 288 is being tightened or loosened. The additive advantage of the having multiple flaps proximate to aperture 270 is that the additional material further supports the holder 280 while the torque forces tightening or loosening cap 288 are applied.

In one embodiment, enclosure 102 has a moisture resistant, but not waterproof, coating applied. In one embodiment, the moisture resistant coating is applied to the exterior surfaces of enclosure 102.

In one embodiment, enclosure 102 is constructed by folding foldable component 106 so that first side 114 is generally parallel with third side 118, second side 116 is generally parallel with fourth side 120, and side flap 128 overlaps a portion of fourth side 120. Side flap 128 being visible from an exterior of enclosure 102. First side 114, second side 116, third side 118, and fourth side 120 having a lower perimeter 170. Side flap 128 is secured to portion 136 of fourth side 120. Bottom portion 105 is formed such that uninterrupted bottom wall 190 of second bottom flap 146 is generally perpendicular to first side 114 and is visible from a direction 302 (see FIG. 9) looking down through first side 114, second side 116, third side 118, and fourth side 120. Uninterrupted bottom wall 190 has a flap perimeter 172 which generally matches the lower perimeter 170 of the plurality of sides. The plurality of bottom flaps are secured to at least two of the plurality of sides of the enclosure 102. The top flaps are folded to form the top portion 103 of the enclosure 102. The plurality of top flaps are secured to at least two of the plurality of sides of the enclosure 102.

Once enclosure 102 is constructed, fillable bladder 104 is placed in interior of enclosure 102. Fillable bladder 104 is coupled to holder 280 which is supported by the enclosure. Holder 280 includes opening 287 through which a pourable product may be placed into an interior 286 of the fillable bladder 104. The pourable product is then placed into the interior 286 of the fillable bladder 104. Opening 287 of holder 280 is then closed to retain the pourable product in the interior 286 of the fillable bladder 104.

In one embodiment, a method of pouring a pourable product from a container 100 includes the steps of obtaining a container 100 having a pourable product positioned within a fillable bladder 104 positioned in an interior 101 of an enclosure 102. An interior 286 of fillable bladder 104 being in fluid communication with an exterior of the container 100 through a neck 284. An operator grips container 100 through a handle 248 in a rear portion 244 of the container 100 and a blind depth handle 198 on a bottom portion 105 of the container 100. The blind depth handle 198 being spaced further from the neck 284 than the handle 248 is spaced from the neck 284. The operator then raises bottom portion 105 of container 100 relative to top portion 103 of container 100 while gripping the handle 248 and the blind depth handle 198 to pour the pourable product through the neck 284 of the container 100.

Figure 10:
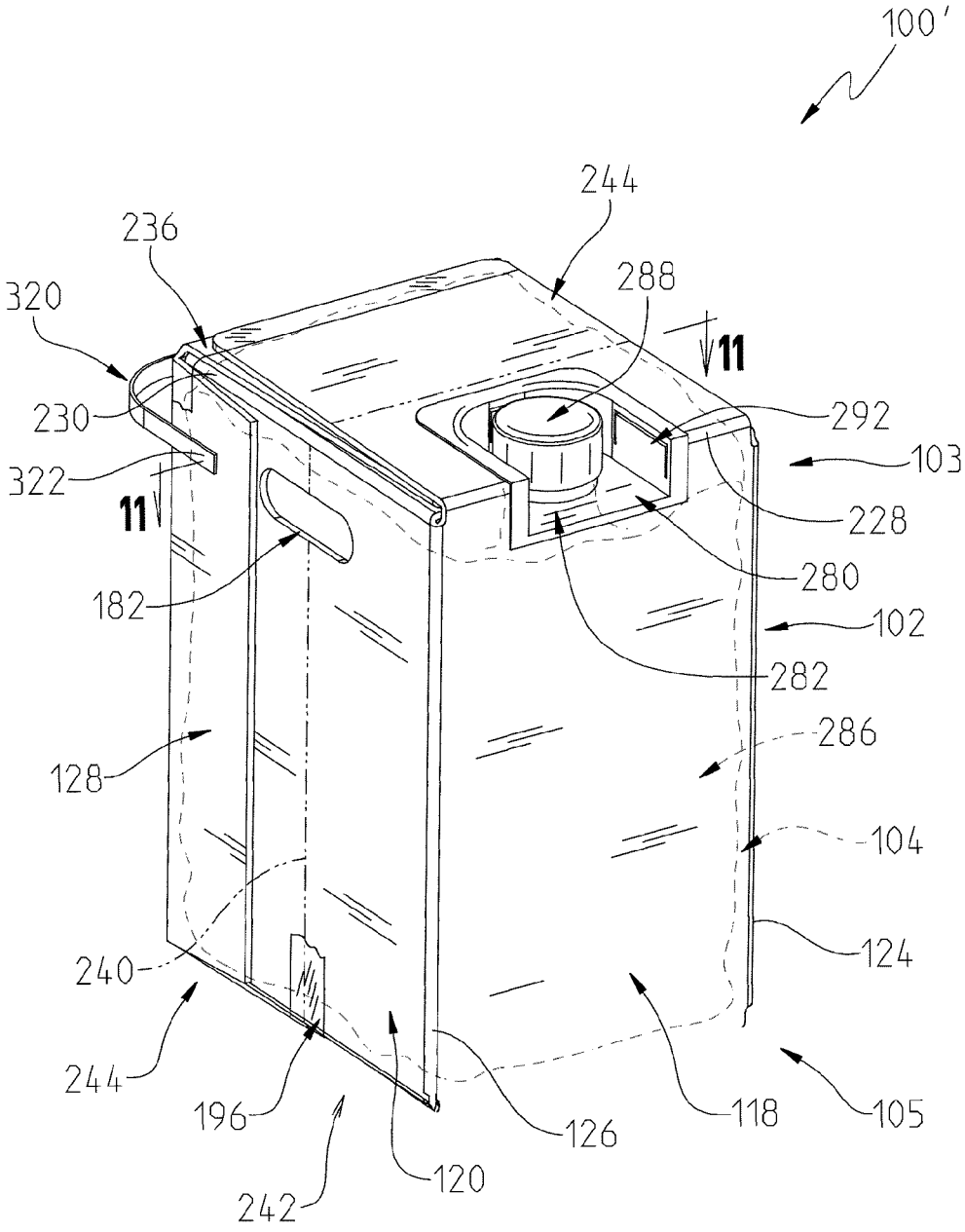
FIG. 10 is a perspective view of another container generally similar to the container of FIG. 1 wherein the top handle is replaced with a strap handle.

Referring to FIGS. 10 and 11, an alternative container 100' is shown. Container 100' is the same as container 100 expect that handle 248 is replaced or supplemented with a strap handle 320. Strap handle 320 includes a first portion 322 attached to side flap 128, a second portion 324 attached to side 116, and a third portion 326 extending from the first portion 322 to the second portion 324. An operator places their hand in region 330 between third portion 326 of strap handle 320 and side 114 and grasps third portion 326 of strap handle 320.

In one embodiment, strap handle 320 is a polymer material. In one embodiment, strap handle 320 is a fiber material. Strap handle 320 includes an adhesive which is applied to the side of first portion 322 facing side flap 128 and the side of second portion 324 facing side 116. In one embodiment, a removable film is provided over the adhesive. The removable film is removed from the strap handle and the first portion and the second portion are secured to the enclosure 102. Third portion 326 does not include an adhesive section.

Strap handle 320 is shown attached to side flap 128 and side 116. However, strap handle may be attached to any of the sections of foldable component 106. In one embodiment, strap handle 320 is attached to foldable component 106 in a manner other than adhesive, such as snap features being provided on both foldable component 106 and strap handle 320.

In one embodiment, a method of pouring a pourable product from a container 100' includes the steps of obtaining a container 100' having the pourable product positioned within a fillable bladder 104 positioned in an interior 101 of an enclosure 102 of the container 100'. An interior 286 of the fillable bladder 104 being in fluid communication with an exterior of the container 100' through a neck 284. An operator grips the container 100' through a strap handle 320 in a rear portion 244 of the container 100' and a blind depth handle 198 on a bottom portion 105 of the container 100'. The blind depth handle 198 being spaced further from the neck 284 than the strap handle 320 is spaced from the neck 284. The operator then raises the bottom portion 105 of the container 100' relative to the top 103 while gripping the strap handle 320 and the blind depth handle 198 to pour the pourable product through the neck 284 of the container 100'.

While this disclosure has been described as having exemplary designs, the present disclosure can be further modified within the spirit and scope of this disclosure. For example, all of the disclosed components of the preferred and alternative embodiments are interchangeable providing disclosure herein of many systems having combinations of all the preferred and alternative embodiment components. This application is therefore intended to cover any variations, uses, or adaptations of the disclosure using its general principles. Further, this application is intended to cover such departures from the present disclosure as come within known or customary practice in the art to which this disclosure pertains and which fall within the limits of the appended claims.

The invention claimed is:

1. A container, comprising:

an enclosure formed from a single piece of corrugated material having an unfolded state and a folded state including a bottom portion, a top portion, and a plurality of sides which bound an interior of the enclosure, the plurality of sides having a lower perimeter and the bottom portion being formed from a plurality of bottom flaps extending from one or more of the plurality of sides, and a fillable bladder positioned within the enclosure, an interior of the fillable bladder being accessible through an opening in the enclosure, wherein a first bottom flap of the plurality of bottom flaps is positioned adjacent the fillable bladder and has a flap perimeter which substantially matches the lower perimeter of the plurality of sides; wherein the corrugated material includes a first side, a second side, a third side, and a fourth side which form the plurality of sides;

a first top flap extending form the first side, a second top flap extending from the second side, a third top flap extending from the third side, and a fourth top flap extending from the fourth side which form the top portion;

the first bottom flap extending from the first side, a second bottom flap extending from the second side, a third bottom flap extending form the third side, and a fourth bottom flap extending from the fourth side which form the bottom portion; and a side flap extending from the first side opposite the second side, wherein the side flap overlaps and is secured to a portion of the fourth side when the corrugated material is in the folded state, wherein the third side and the third top flap include edges which define an exterior edge of the opening of the enclosure; the first top flap, the second top flap, and the fourth top flap each include a first recess which correspond to the opening of the enclosure;

a handle in the top portion is formed by a handle opening in each of the first top flap and the third top flap and a second recess in each of the second top flap and the fourth top flap; a first side handle is formed by an opening in the second side; and a second side handle is formed by an opening in the fourth side.

2. The container of claim 1, wherein the side flap and the portion of the fourth side are secured with an adhesive and at least one of the side flap and the portion of the fourth side includes perforations which allow for the adhesive to penetrate into an interior of the respective at least one of the side flap and the portion of the fourth side.

3. The container of claim 1, further comprising a holder including a base which is supported by the enclosure, a neck which is coupled to the base and is in fluid communication with the interior of the fillable bladder; and a cap which is removably coupled to the neck.

4. The container of claim 3, wherein the base includes a plurality of locking members which engage the enclosure to couple the base to the enclosure.

5. The container of claim 4, wherein the plurality of locking members engage a portion of an inward-facing surface of the third top flap, the portion of the inward-facing surface of the third top flap being exposed by the first recess in each of the first top flap, the second top flap, and the third top flap.

6. The container of claim 1, wherein the interior of the fillable bladder is accessible only through a single opening in the fillable bladder.

7. The container of claim 6, wherein the top portion includes a plurality of corners, the opening in the enclosure being spaced apart from each of the plurality of corners.

8. The container of claim 1, wherein the first bottom flap has a uniform thickness.

9. The container of claim 1, wherein the bottom portion includes a blind depth handle having a bottom surface spaced apart from a first surface of the first bottom flap which faces the interior of the enclosure.

10. The container of claim 9, wherein the blind depth handle is formed by an aperture in at least the second bottom flap and a surface of at least one of the plurality of bottom flaps which faces away from the interior of the enclosure corresponding to the bottom surface of the blind depth handle, the second bottom flap forming a portion of an exterior of the enclosure.

11. The container of claim 10, wherein the handle in the top portion is in communication with the interior of the enclosure, the handle in the top portion and the blind depth handle of the bottom portion aiding in a pouring of a liquid from the interior of the fillable bladder through the opening in the enclosure.

12. The container of claim 9, wherein a bottom surface of the blind depth recess handle is formed by a continuous surface of the first bottom flap and the blind depth recess handle extends across a centerline plane of the enclosure.

13. The container of claim 12, wherein the opening in the enclosure is in a front half of the enclosure, the handle in the top portion and the blind depth recess handle are in a rear half of the enclosure, and the handle is in the top portion of the enclosure and is in communication with the interior of the enclosure.

14. The container of claim 12, wherein the blind depth recess handle is formed by an aperture in one of the plurality of bottom flaps, the one of the plurality of bottom flaps forming a portion of an exterior of the enclosure.

* * * * *